US008096643B2

(12) United States Patent
Olbrich et al.

(10) Patent No.: US 8,096,643 B2
(45) Date of Patent: Jan. 17, 2012

(54) FLUID EJECTION DEVICE

(75) Inventors: Craig A. Olbrich, Corvallis, OR (US); Jeffrey A. Nielsen, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1131 days.

(21) Appl. No.: 11/871,800

(22) Filed: Oct. 12, 2007

(65) Prior Publication Data

US 2009/0096839 A1 Apr. 16, 2009

(51) Int. Cl.
*B41J 2/05* (2006.01)

(52) U.S. Cl. ..... 347/62; 216/27

(58) Field of Classification Search ..... 347/62; 216/27

See application file for complete search history.

(56) References Cited

U.S. PATENT DOCUMENTS

| | | | | |
|---|---|---|---|---|
| 4,882,595 | A | 11/1989 | Trueba et al. | |
| 5,592,204 | A * | 1/1997 | Lin et al. | 347/88 |
| 5,638,101 | A | 6/1997 | Keefe et al. | |
| 5,874,974 | A * | 2/1999 | Courian et al. | 347/65 |
| 6,039,438 | A * | 3/2000 | Beerling | 347/63 |
| 6,502,915 | B1 | 1/2003 | Feinn et al. | |
| 6,513,896 | B1 * | 2/2003 | Kawamura | 347/15 |
| 6,729,715 | B2 * | 5/2004 | Gonzalez | 347/63 |
| 6,746,106 | B1 | 6/2004 | Hager | |
| 6,951,383 | B2 | 10/2005 | Giere et al. | |
| 2003/0222941 | A1 * | 12/2003 | Kaneko et al. | 347/56 |
| 2005/0190235 | A1 * | 9/2005 | Raman | 347/54 |
| 2006/0187266 | A1 | 8/2006 | Rivos et al. | |
| 2006/0268067 | A1 | 11/2006 | Agarwal et al. | |
| 2006/0268071 | A1 * | 11/2006 | Fellner et al. | 347/65 |

FOREIGN PATENT DOCUMENTS

| | | |
|---|---|---|
| JP | 55067473 | 5/1980 |

OTHER PUBLICATIONS

International Search Report for Application No. PCT/US2008/077793. Report issued Mar. 31, 2009.

Supplementary European Search Report for Application No. 08839753.4; Report issued Jan. 31, 2011.

* cited by examiner

*Primary Examiner* — Charlie Peng
*Assistant Examiner* — Peter Radkowski

(57) ABSTRACT

A fluid ejection device includes a fluid chamber, a resistor formed within the fluid chamber, and an orifice communicated with the fluid chamber, wherein the fluid ejection device is adapted to eject drops of a non-aqueous fluid, and wherein a ratio of a square root of an area of the resistor to a diameter of the orifice is in a range of approximately 1.75 to approximately 2.25.

20 Claims, 3 Drawing Sheets

| | NON-AQUEOUS | | AQUEOUS |
|---|---|---|---|
| BARRIER LAYER THICKNESS, T (um) | 14 +/- 1um | | |
| ORIFICE LAYER THICKNESS, t (um) | 9 +/- 1um | | |
| **FLUID PROPERTIES** | **EXEMPLARY** | **RANGE** | **RANGE** |
| VISCOSITY (cP) | 1.77 | 0.4-2.5 | 1.5-3.0 |
| SURFACE TENSION (dynes/cm) | 21.7 | 19-27 | 20-60 |
| **SYSTEM PERFORMANCE** | **EXEMPLARY** | **RANGE** | **RANGE** |
| DROP WEIGHT (ng) | 2.5 | 1.5-4.0 | 4.0-7.0 |
| DROP VELOCITY (m/s) | 12 | 10-15 | 10-15 |
| FREQUENCY RANGE (kHz) | 30 | 0-36 | 0-36 |
| **DESIGN PARAMETERS** | **EXEMPLARY** | **RANGE** | **RANGE** |
| RESISTOR AREA (um*um) | 582 | 450-675 | 350-500 |
| RESISTOR SIZE (um) | 24.1 | 21-26 | 18.7-22.4 |
| ORIFICE DIAMETER, d (um) | 12 | 10-15 | 13-16.5 |
| PINCH WIDTH, W (um) | 12 | 10-16 | 8-16 |
| PINCH LENGTH, L (um) | 6 | 5-10 | 5-20 |
| SHELF LENGTH, D (um) | 56 | 51-61 | 46-76 |

*Fig. 5*

FLUID EJECTION DEVICE

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

Typically, the printhead is operated to eject water-based inks. In an effort to expand the fluids which can be ejected by the printhead, non-aqueous fluids are being considered. Compared to water-based inks, however, non-aqueous fluids have different fluid properties and, therefore, different performance characteristics and operating constraints. Accordingly, to optimize performance of the printhead, it is desirable to select or tune parameters of the printhead to accommodate non-aqueous fluids.

SUMMARY

One aspect of the present invention provides a fluid ejection device. The fluid ejection device includes a fluid chamber, a resistor formed within the fluid chamber, and an orifice communicated with the fluid chamber, wherein the fluid ejection device is adapted to eject drops of a non-aqueous fluid, and wherein a ratio of a square root of an area of the resistor to a diameter of the orifice is in a range of approximately 1.75 to approximately 2.25.

BRIEF DESCRIPTION OF THE DRAWINGS

FIG. 5 is a table outlining one embodiment of exemplary parameters and exemplary ranges of parameters of a fluid ejection device according to the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
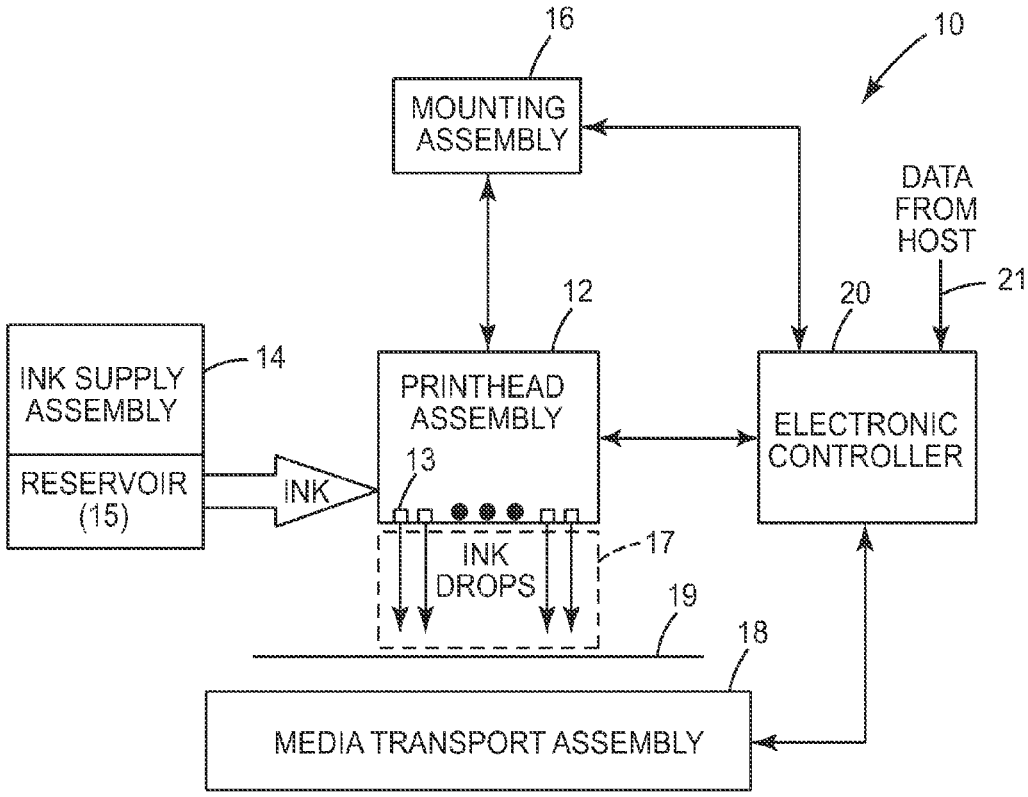
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images including, for example, date codes, 1-D bar codes, and 2-D bar codes to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
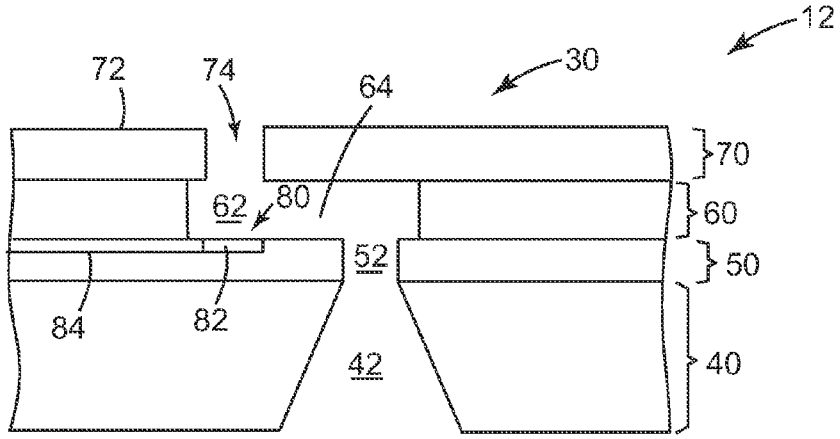
FIG. 2 is a schematic cross-sectional view illustrating one embodiment of a portion of a fluid ejection device according to the present invention.

FIG. 2 illustrates one embodiment of a portion of printhead assembly 12. Printhead assembly 12, as one embodiment of a fluid ejection device, includes an array of drop ejecting elements 30. Drop ejecting elements 30 are formed on a substrate 40 which has a fluid (or ink) feed slot 42 formed therein. As such, fluid feed slot 42 provides a supply of fluid (or ink) to drop ejecting elements 30.

In one embodiment, each drop ejecting element 30 includes a thin-film structure 50, a barrier layer 60, an orifice layer 70, and a drop generator 80. Thin-film structure 50 has a fluid (or ink) feed opening 52 formed therein which communicates with fluid feed slot 42 of substrate 40 and barrier layer 60 has a fluid ejection chamber 62 and one or more fluid channels 64 formed therein such that fluid ejection chamber 62 communicates with fluid feed opening 52 via fluid channels 64.

Orifice layer 70 has a front face 72 and an orifice or nozzle opening 74 formed in front face 72. Orifice layer 70 is extended over barrier layer 60 such that nozzle opening 74 communicates with fluid ejection chamber 62. In one embodiment, drop generator 80 includes a resistor 82. Resistor 82 is positioned within fluid ejection chamber 62 and is electrically coupled by leads 84 to drive signal(s) and ground.

While barrier layer 60 and orifice layer 70 are illustrated as separate layers, in other embodiments, barrier layer 60 and orifice layer 70 may be formed as a single layer of material with fluid ejection chamber 62, fluid channels 64, and/or nozzle opening 74 formed in the single layer. In addition, in one embodiment, portions of fluid ejection chamber 62, fluid channels 64, and/or nozzle opening 74 may be shared between or formed in both barrier layer 60 and orifice layer 70.

In one embodiment, during operation, fluid flows from fluid feed slot 42 to fluid ejection chamber 62 via fluid feed opening 52 and one or more fluid channels 64. Nozzle opening 74 is operatively associated with resistor 82 such that droplets of fluid are ejected from fluid ejection chamber 62 through nozzle opening 74 (e.g., substantially normal to the plane of resistor 82) and toward a print medium upon energization of resistor 82.

In one embodiment, printhead assembly 12 is a fully integrated thermal inkjet printhead. As such, substrate 40 is formed, for example, of silicon, glass, or a stable polymer, and thin-film structure 50 includes one or more passivation or insulation layers formed, for example, of silicon dioxide, silicon carbide, silicon nitride, tantalum, poly-silicon glass, or other material. Thin-film structure 50 also includes a conductive layer which defines resistor 82 and leads 84. The conductive layer is formed, for example, by aluminum, gold, tantalum, tantalum-aluminum, or other metal or metal alloy. In addition, barrier layer 60 is formed, for example, of a photoimageable epoxy resin, such as SU8, and orifice layer 70 is formed of one or more layers of material including, for example, a metallic material, such as nickel, copper, iron/nickel alloys, palladium, gold, or rhodium. Other materials, however, may be used for barrier layer 60 and/or orifice layer 70.

Figure 3:
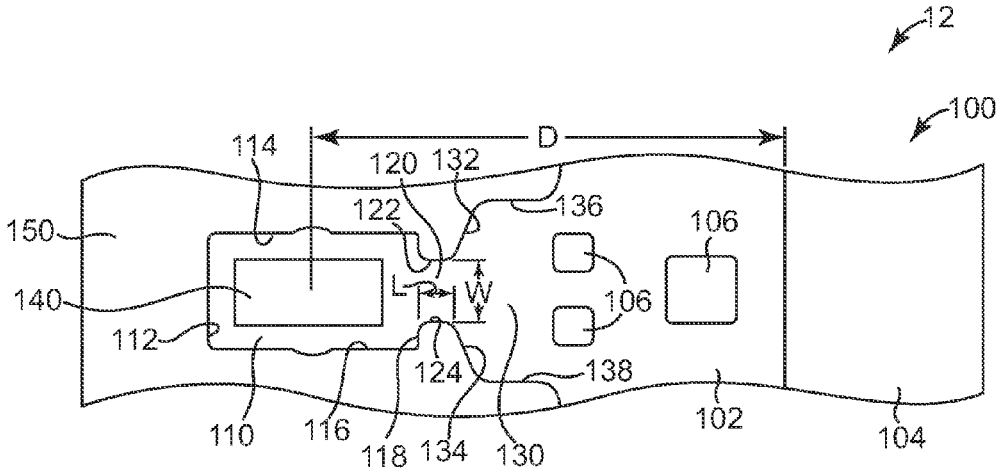
FIG. 3 is a plan view illustrating one embodiment of a portion of a fluid ejection device according to the present invention.

FIG. 3 illustrates one embodiment of a portion of a fluid ejection device, such as printhead 12, with the orifice layer removed. Fluid ejection device 100 includes a fluid ejection chamber 110, a fluid restriction 120, and a fluid channel 130. In one embodiment, fluid ejection chamber 110 includes an end wall 112, opposite sidewalls 114 and 116, and an end wall 118. As such, boundaries of fluid ejection chamber 110 are defined generally by end wall 112, opposite sidewalls 114 and 116, and end wall 118. In one embodiment, end walls 112 and 118 are oriented substantially parallel with each other, and sidewalls 114 and 116 are oriented substantially parallel with each other.

In one embodiment, fluid restriction 120 communicates with and is provided in a fluid flow path between fluid channel 130 and fluid ejection chamber 110. Parameters of fluid restriction 120 and fluid channel 130 are defined, as described below, to optimize operation or performance of fluid ejection device 100.

In one embodiment, fluid restriction 120 includes sidewalls 122 and 124, and fluid channel 130 includes sidewalls 132 and 134, and sidewalls 136 and 138. In one embodiment, sidewalls 122 and 124 of fluid restriction 120 are oriented substantially parallel with each other. In addition, sidewalls 122 and 124 are each oriented substantially perpendicular to fluid ejection chamber 110 and, more specifically, end wall 118 of fluid ejection chamber 110. In addition, in one embodiment, sidewalls 132 and 134 of fluid channel 130 are substantially linear and are each oriented at an angle to fluid restriction 120 and, more specifically, sidewalls 122 and 124 of fluid restriction 120. Furthermore, sidewalls 136 and 138 of fluid channel 130 are substantially linear and are each oriented substantially parallel with fluid restriction 120 and, more specifically, sidewalls 122 and 124 of fluid restriction 120.

In one embodiment, fluid channel 130 communicates with a supply of fluid via a fluid feed slot 104 (only one edge of which is shown in the figure) formed in a substrate 102 of fluid ejection device 100. As described above, fluid channel 130 communicates with fluid restriction 120 and, as such, supplies fluid from fluid feed slot 104 to fluid ejection chamber 110 via fluid restriction 120. In one embodiment, one or more islands 106 are formed on substrate 102 of fluid ejection device 100 within fluid channel 130. As such, islands 106 form particle filter features within fluid channel 130.

In one embodiment, a resistor 140, as one embodiment of a drop generator, is positioned within fluid ejection chamber 110 such that droplets of fluid are ejected from fluid ejection chamber 110 by activation of resistor 140, as described above. As such, the boundaries of fluid ejection chamber 110 are defined to encompass or surround resistor 140. Although illustrated as a single resistor, it is within the scope of the present invention for resistor 140 to include a single resistor, a split resistor, or multiple resistors.

Figure 4:
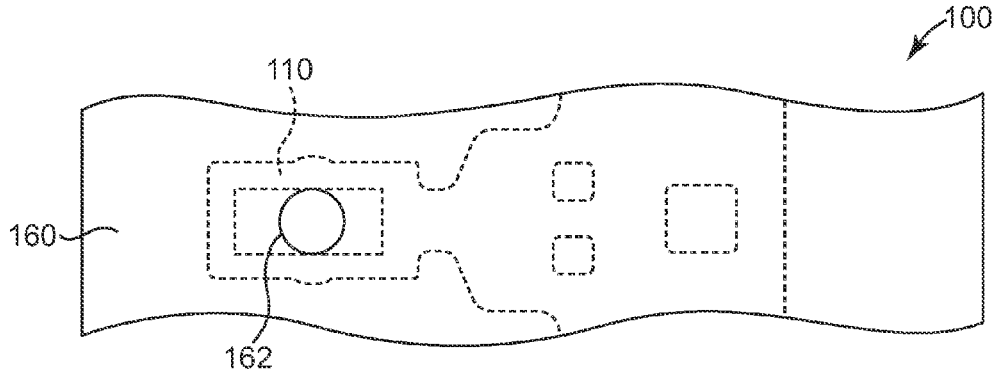
FIG. 4 is a plan view illustrating one embodiment of including an orifice layer with the fluid ejection device of FIG. 3.

In one embodiment, as illustrated in FIG. 3, fluid ejection chamber 110, fluid restriction 120, and fluid channel 130 of fluid ejection device 100 are defined in a barrier layer 150 as formed on substrate 102. In addition, in one embodiment, as illustrated in FIG. 4, an orifice layer 160 having an orifice 162 formed therein is extended over barrier layer 150 of fluid ejection device 100. Accordingly, orifice 162 communicates with fluid ejection chamber 110 such that fluid ejected from fluid ejection chamber 110 is expelled through orifice 162.

In one embodiment, a plurality of fluid ejection devices 100 are formed on a common substrate and are arranged to substantially form one or more columns of drop ejecting elements. As such, drop ejecting elements of respective fluid ejection devices 100 may be used for ejecting fluid from printhead 12. In one exemplary embodiment, fluid ejection device 100 is optimized for use with non-aqueous fluids, as described below.

In one embodiment, as illustrated in FIGS. 3 and 4 and as outlined in the table of FIG. 5, various parameters of fluid ejection device 100 are selected to optimize or improve performance of fluid ejection device 100. In one embodiment, for example, a pinch width W and a pinch length L of fluid restriction 120 is optimized. In addition, a shelf length or distance D from an edge of fluid feed slot 104 to a center of fluid chamber 110 is optimized. Furthermore, in one embodiment, an area of resistor 140 and a diameter of orifice 162 are also optimized.

In one exemplary embodiment, as illustrated in the table of FIG. 5, a thickness T of barrier layer 150, as well as a thickness t of orifice layer 160 is generally fixed. In one embodiment thickness T of barrier layer 150 establishes the height or depth of fluid ejection chamber 110, fluid restriction 120, and fluid channel 130. Thus, by optimizing select parameters of fluid ejection device 100, as described above, the volume and/or rate of fluid supplied to fluid chamber 110 can be optimized.

In one embodiment, pinch width W of fluid restriction 120 is measured between respective sidewalls 122 and 124 and is substantially constant. In addition, pinch length L of fluid restriction 120 is measured along respective sidewalls 122 and 124 between sidewalls 132 and 134 of fluid channel 130 and end wall 118 of fluid ejection chamber 110.

In one embodiment, the feed rate of fluid ejection chamber 110 is directly proportional to the cross-sectional area of fluid restriction 120. Accordingly, the cross-sectional area of fluid restriction 120 is defined by the height or depth of fluid restriction 120 and the width of fluid restriction 120. In one embodiment, the cross-sectional area of fluid restriction 120 is substantially rectangular in shape. The cross-sectional area of fluid restriction 120, however, may be other shapes.

In one embodiment, fluid ejection device 100 is optimized for use with non-aqueous fluids. Examples of such fluids include ethanol, methanol, and isopropyl alcohol. Accordingly, such fluids constitutes solvents to be ejected from fluid ejection device 100. In one exemplary embodiment, a surface tension of non-aqueous fluid ejected from fluid ejection device 100 is in a range of approximately 19 dynes/centimeter to approximately 27 dynes/centimeter, and a viscosity of non-aqueous fluid ejected from fluid ejection device 100 is in a range of approximately 0.4 centipoise to approximately 2.5 centipoise.

In one embodiment, fluid ejection device 100 is optimized to produce droplets of non-aqueous fluid which are of substantially uniform or constant drop weight. In one exemplary embodiment, a drop weight of droplets of non-aqueous fluid ejected from fluid ejection device 100 is in a range of approximately 1.5 nanograms to approximately 4.0 nanograms. In addition, in one exemplary embodiment, a drop velocity of droplets of non-aqueous fluid ejected from fluid ejection device 100 is in a range of approximately 10 meters/second to approximately 15 meters/second. Furthermore, in one exemplary embodiment, fluid ejection device 100 is optimized for operation over an operating range of up to at least approximately 36 kilohertz.

In one embodiment, resistor and orifice dimensions of fluid ejection device 100 are optimized to optimize performance of fluid ejection device 100 for use with non-aqueous fluids. In one embodiment, resistor size is defined as a square root of the resistor area, and orifice size is defined as a diameter of the orifice opening. As such, a resistor-to-orifice ratio (R/O) is established based on the square root of the resistor area and the diameter of the orifice opening. In one exemplary embodiment, the resistor-to-orifice ratio of fluid ejection device 100 is in a range of approximately 1.75 to approximately 2.25. Accordingly, the resistor-to-orifice ratio is optimized to optimize performance of fluid ejection device 100 for use with non-aqueous fluids.

In one embodiment, as described above, fluid ejection device 100 is tuned to optimize performance with non-aqueous fluids. In one exemplary embodiment, as illustrated in the table of FIG. 5, parameters of fluid ejection device 100, such as resistor area and orifice diameter (which establish the resistor-to-orifice ratio (R/O)), pinch width W and pinch length L of fluid restriction 120, as well as shelf length D, therefore, are selected to optimize performance of fluid ejection device 100. Accordingly, fluid ejection device 100 may be operated to eject non-aqueous fluids.

As a comparison, the table of FIG. 5 also includes corresponding design parameters of a fluid ejection device optimized for use with aqueous fluids, such as water-based inks. In addition, the table of FIG. 5 also includes corresponding fluid properties and system performance of a fluid ejection device optimized for use with aqueous fluids, such as water-based inks.

In addition to be used for printing on paper-type media, as described above, fluid ejection device 100 may also be used for other 'non-media' applications such as product marking. For example, when used with non-aqueous fluids, fluid ejection device 100 may be used for marking on other non-porous substrates (for example, the bottoms of soda cans). Furthermore, in addition to creating images, fluid ejection device 100 may also be used for material deposition applications. Examples of such materials include polymers, active pharmaceuticals, chemical precursors, or other materials dissolved in a solution wherein small quantities of the solute remain once the solvent is evaporated.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a fluid chamber;

a resistor formed within the fluid chamber;

a fluid restriction communicated with the fluid chamber; and an orifice communicated with the fluid chamber, wherein the fluid ejection device is adapted to eject drops of a non-aqueous fluid, wherein a width of the fluid restriction is approximately equal to or greater than a length of the fluid restriction with the width of the fluid restriction being in a range of approximately 10 microns to approximately 16 microns in combination with the length of the fluid restriction being in a range of approximately 5 microns to approximately 10 microns, and wherein a ratio of a square root of an area of the resistor to a diameter of the orifice is in a range of approximately 1.75 to approximately 2.25.

2. The fluid ejection device of claim 1, wherein the area of the resistor is in a range of approximately 450 square microns to approximately 675 square microns.

3. The fluid ejection device of claim 1, wherein the diameter of the orifice is in a range of approximately 10 microns to approximately 15 microns.

4. The fluid ejection device of claim 1, wherein the area of the resistor is in a range of approximately 450 square microns to approximately 675 square microns, and wherein the diameter of the orifice is in a range of approximately 10 microns to approximately 15 microns.

5. The fluid ejection device of claim 1, wherein the fluid chamber is defined with a barrier layer and the orifice is formed in an orifice layer, wherein a thickness of the barrier layer is greater than a thickness of the orifice layer with the thickness of the barrier layer being approximately 14 microns in combination with the thickness of the orifice layer being approximately 9 microns.

6. The fluid ejection device of claim 1, further comprising:

a supply of the non-aqueous fluid communicated with the fluid chamber, wherein the non-aqueous fluid has a surface tension in a range of approximately 19 dynes/centimeter to approximately 27 dynes/centimeter, and a viscosity in a range of approximately 0.4 centipoise to approximately 2.5 centipoise.

7. A fluid ejection device, comprising:

a substrate;

a barrier layer formed on the substrate and defining a fluid chamber;

an orifice layer extended over the barrier layer and having an orifice communicated with the fluid chamber; and a resistor formed on the substrate and communicated with the fluid chamber, wherein the fluid ejection device is adapted to eject drops of a non-aqueous fluid, wherein a thickness of the barrier layer is greater than a thickness of the orifice layer with the thickness of the barrier layer being approximately 14 microns in combination with the thickness of the orifice layer being approximately 9 microns, and wherein a ratio of a square root of an area of the resistor to a diameter of the orifice is in a range of approximately 1.75 to approximately 2.25.

8. The fluid ejection device of claim 7, wherein the area of the resistor is in a range of approximately 450 square microns to approximately 675 square microns.

9. The fluid ejection device of claim 7, wherein the diameter of the orifice is in a range of approximately 10 microns to approximately 15 microns.

10. The fluid ejection device of claim 7, wherein the barrier layer further defines a fluid restriction communicated with the fluid chamber and a fluid channel communicated with the fluid restriction, wherein a width of the fluid restriction is approximately equal to or greater than a length of the fluid restriction with the width of the fluid restriction being in a range of approximately 10 microns to approximately 16 microns in combination with the length of the fluid restriction being in a range of approximately 5 microns to approximately 10 microns.

11. The fluid ejection device of claim 10, wherein the substrate has a fluid feed slot formed therein, wherein the fluid channel is communicated with the fluid feed slot, and wherein a distance from an edge of the fluid feed slot to a center of the fluid chamber is in a range of approximately 51 microns to approximately 61 microns.

12. The fluid ejection device claim 7, further comprising:

a supply of the non-aqueous fluid communicated with the fluid chamber, wherein the non-aqueous fluid has a surface tension in a range of approximately 19 dynes/centimeter to approximately 27 dynes/centimeter, and a viscosity in a range of approximately 0.4 centipoise to approximately 2.5 centipoise.

13. A method of forming a fluid ejection device, comprising: forming a barrier layer on a substrate, including defining a fluid chamber with the barrier layer; extending an orifice layer over the barrier layer, including communicating an orifice of the orifice layer with the fluid chamber; and forming a resistor on the substrate, including communicating the resistor with the fluid chamber, wherein the fluid ejection device is adapted to eject drops of a non-aqueous fluid, and wherein a thickness of the barrier layer is greater than a thickness of the orifice layer with the thickness of the barrier layer being approximately 14 microns in combination with the thickness of the orifice layer being approximately 9 microns, and wherein a ratio of a square root of an area of the resistor to a diameter of the orifice is in a range of approximately 1.75 to approximately 2.25.

14. The method of claim 13, wherein the area of the resistor is in a range of approximately 450 square microns to approximately 675 square microns.

15. The method of claim 13, wherein the diameter of the orifice is in a range of approximately 10 microns to approximately 15 microns.

16. The method of claim 13, wherein forming the barrier layer further includes defining a fluid restriction communicating with the fluid chamber and a fluid channel communicating with the fluid restriction, wherein the fluid restriction has a width in a range of approximately 10 microns to approximately 16 microns, and a length in a range of approximately 5 microns to approximately 10 microns.

17. The method of claim 16, further comprising:

forming a fluid feed slot in the substrate, wherein defining the fluid channel includes communicating the fluid channel with the fluid feed slot, and wherein a distance from an edge of the fluid feed slot to a center of the fluid chamber is in a range of approximately 51 microns to approximately 61 microns.

18. The method of claim 13, wherein the non-aqueous fluid has a surface tension in a range of approximately 19 dynes/centimeter to approximately 27 dynes/centimeter, and a viscosity in a range of approximately 0.4 centipoise to approximately 2.5 centipoise.

19. The fluid ejection device of claim 1, wherein, with the width of the fluid restriction being approximately equal to or greater than the length of the fluid restriction and the width of the fluid restriction being in a range of approximately 10 microns to approximately 16 microns in combination with the length of the fluid restriction being in a range of approximately 5 microns to approximately 10 microns, and the ratio of the square root of the area of the resistor to the diameter of the orifice being in the range of approximately 1.75 to approximately 2.25, the fluid ejection device is adapted to eject drops of the non-aqueous fluid with a drop weight in a range of approximately 1.5 nanograms to approximately 4.0 nanograms.

20. The fluid ejection device of claim 7, wherein, with the thickness of the barrier layer being greater than the thickness of the orifice layer and the thickness of the barrier layer being approximately 14 microns in combination with the thickness of the orifice layer being approximately 9 microns, and the ratio of the square root of the area of the resistor to the diameter of the orifice being in the range of approximately 1.75 to approximately 2.25, the fluid ejection device is adapted to eject drops of the non-aqueous fluid with a drop weight in a range of approximately 1.5 nanograms to approximately 4.0 nanograms.

* * * * *

UNITED STATES PATENT AND TRADEMARK OFFICE

CERTIFICATE OF CORRECTION

PATENT NO. : 8,096,643 B2
APPLICATION NO. : 11/871800
DATED : January 17, 2012
INVENTOR(S) : Craig A. Olbrich et al.

It is certified that error appears in the above-identified patent and that said Letters Patent is hereby corrected as shown below:

In column 8, line 10, in Claim 12, delete "device" and insert -- device of --, therefor.

Signed and Sealed this
Sixteenth Day of October, 2012

David J. Kappos

David J. Kappos
*Director of the United States Patent and Trademark Office*